US006360504B1

(12) United States Patent
Webb et al.

(10) Patent No.: US 6,360,504 B1
(45) Date of Patent: Mar. 26, 2002

(54) COPING ASSEMBLY FOR BUILDING ROOF

(75) Inventors: William C. Webb, Fletcher; Neil Tedder, Asheville; Christopher K. McCoy, Candler; David McKinney, Weaverville, all of NC (US)

(73) Assignee: W. P. Hickman Company, Asheville, NC (US)

( * ) Notice: Subject to any disclaimer, the term of this patent is extended or adjusted under 35 U.S.C. 154(b) by 0 days.

(21) Appl. No.: 09/598,003

(22) Filed: Jun. 20, 2000

Related U.S. Application Data

(63) Continuation-in-part of application No. 09/544,409, filed on Apr. 6, 2000.

(51) Int. Cl.[7] ..... E04F 19/02
(52) U.S. Cl. ..... 52/300; 52/96; 52/60
(58) Field of Search ..... 52/300, 96, 94, 52/58, 60

(56) References Cited

U.S. PATENT DOCUMENTS

| | | | |
|---|---|---|---|
| 1,337,840 | A | 4/1920 | Hawley |
| 1,740,753 | A | 12/1929 | Vallas |
| 1,782,246 | A | 11/1930 | Schneider |
| 2,554,779 | A | 5/1951 | Goodwin |
| 2,734,602 | A | 2/1956 | Dawson |
| 2,855,776 | A | 10/1958 | Trostle |
| 3,012,376 | A | 12/1961 | Reddy et al. |
| 3,024,573 | A | 3/1962 | McKinley |
| 3,187,464 | A | 6/1965 | Sharp |
| 3,237,352 | A | 3/1966 | Edwards |
| 3,404,495 | A | 10/1968 | Simpson, Jr. |
| 3,405,485 | A | 10/1968 | Edwards |
| 3,447,273 | A | 6/1969 | Thom |
| 3,503,162 | A | 3/1970 | Ward |
| 3,634,984 | A | 1/1972 | Murphy |
| 3,668,811 | A | 6/1972 | Pollard |
| 3,719,010 | A | 3/1973 | Hickman |
| 3,802,140 | A | 4/1974 | Hickman |
| 3,862,531 | A | 1/1975 | Attaway et al. |
| RE28,870 | E | 6/1976 | Attaway et al. |
| 4,009,548 | A | 3/1977 | Hicks |
| 4,071,987 | A | 2/1978 | Hickman |
| 4,083,158 | A | 4/1978 | Wolma |
| 4,155,203 | A | 5/1979 | Wolma |
| 4,155,206 | A | 5/1979 | Player |
| 4,404,777 | A | 9/1983 | Lolley et al. |
| 4,419,850 | A | 12/1983 | Butzen |
| 4,439,956 | A | 4/1984 | House |
| 4,472,913 | A | 9/1984 | Hickman |
| 4,483,112 | A | 11/1984 | Rueblinger |

(List continued on next page.)

OTHER PUBLICATIONS

MM Systems "Snap–Iok Coping" (1 page) 1984.
Hickman Permasnap® Coping (1 page) circa. 1974.

(List continued on next page.)

*Primary Examiner*—Robert Canfield
(74) *Attorney, Agent, or Firm*—Kennedy Covington Lobdell & Hickman, LLP

(57) ABSTRACT

A coping assembly for a parapet wall, cant dam or gravel stop resiliently maintains the coping assembly in a tight-fitting interlocking installation and has a locator member beneath the coping cap or cover for maintaining at least a portion of the outer coping cap in a predetermined cross-sectional shape and in an accurate alignment between adjacent sections of the coping cap. The preferred triangular locator member is generally symmetrical with respect to a line normal to the face of the wall, dam stop or other raised roof protrusion and has a free-floating side edge in order to allow it to yield during installation of the coping cap. The coping assembly is quicker, easier, and less costly to install than prior such structures and provides enhanced protection for interior or underlying components or structures.

20 Claims, 15 Drawing Sheets

U.S. PATENT DOCUMENTS

| | | | | |
|---|---|---|---|---|
| 4,488,384 | A | 12/1984 | Hickman | |
| 4,549,376 | A | 10/1985 | Hickman | |
| 4,550,535 | A | 11/1985 | Drogosch | |
| 4,586,301 | A | 5/1986 | Hickman | |
| 4,592,176 | A | 6/1986 | van Herpen | |
| 4,598,507 | A | 7/1986 | Hickman | |
| 4,641,476 | A | 2/1987 | Webb et al. | |
| 4,662,129 | A | 5/1987 | Hickman | |
| 4,780,997 | A | 11/1988 | Taylor et al. | |
| 4,780,999 | A | 11/1988 | Webb et al. | |
| 4,858,406 | A | 8/1989 | Lane et al. | |
| 4,890,426 | A | 1/1990 | Hickman et al. | |
| 4,909,006 | A | 3/1990 | Hickman et al. | |
| 4,964,248 | A | 10/1990 | Braine et al. | |
| 4,969,250 | A | 11/1990 | Hickman et al. | |
| 4,970,832 | A | 11/1990 | van Herpen | |
| 6,212,829 | B1 * | 4/2001 | Webb et al. | 52/96 |

OTHER PUBLICATIONS

Extruded Aluminum Gravel Stops and Copings (2 pages) date unknown.
Construction Specialties C/S Colortrim Coping (2 pages) date unknown.
Trion "Architectural Copings" (1 page) date unknown.
Metal–Era Inc. "Full Coping" (1 page) 1981.
Overly Manufacturing Company "Overly Metal Coping" (4 pages) 1965.
Hickman "Permasnap Coping Controls Water With Unique Gutter/Chair" (1 page) 1982.
Hickman "Formed Products" (1 page) 1986.
MM Systems Catalog pages (4 pages) 1997.
Hickman "The Slimline Fascia/Cap That's An Engineered Parapet Wall" (1 page) 1980.
Dec. 02, 1993 Data sheedt for Double Tapered Coping, Metal–Era Manufacturer's Cataloge, published in USA Brochure entitled "Overly Metal Coping".

* cited by examiner

COPING ASSEMBLY FOR BUILDING ROOF

This application is a continuation-in-part of a previously-filed application, Ser. No. 09/544,409, filed Apr. 6, 2000, which is owned by the same assignee as the current application and is hereby incorporated by reference.

BACKGROUND AND SUMMARY OF THE INVENTION

The present invention relates generally to coping, cover or cap assemblies for covering a parapet wall, cant dam, gravel stop, or other raised upward protrusion extending along the edge or other area of a building roof, as well as to free-standing or other types of walls. More specifically, the present invention relates to such coping assemblies having arrangements for resiliently maintaining the coping assembly in a tight-fitting installation and having a locator member for maintaining at least a portion of the outer coping cap in a predetermined cross-sectional shape and accurately aligned between adjacent sections of the coping cap.

Various coping, cap or cover assemblies for free-standing walls, parapet walls, cant dams, gravel stops, or other such raised protrusions from a building roof have long been provided in the prior art. However, most of such prior coping assemblies have suffered from the same disadvantages of being relatively time-consuming, difficult and costly to install, as well as often being unacceptably misaligned at joints between adjacent end-to-end coping or cover sections. Such misalignment is not only unattractive aesthetically, but it can also result in unacceptable amounts of wind or water being admitted to the interior of the coping assembly structures, thus exposing the structures as well as the walls, cants or stops to potential damage. In addition, many of such prior coping arrangements have lacked a sufficiently tight-fitting installation such that sagging or rattling can occur.

Accordingly, the present invention seeks to overcome the above-mentioned disadvantages of the prior art coping or cover systems by providing a coping, cap or cover, and its underlying structure, that is quicker, easier, and less costly to install. In addition, the present invention provides a tight-fitting assembly with greatly improved alignment between adjacent coping cap or cover sections resulting in a smoother and more pleasing aesthetic appearance, as well as enhanced protection for interior or underlying components or structures.

A coping assembly according to the present invention preferably includes a coping cleat for fixed securement to a raised protrusion, either free-standing or protruding from the building roof, having an upper protrusion surface, an outer protrusion face extending generally downwardly from one side of the upper protrusion surface and an inner protrusion face extending generally downwardly from an opposite, inner side of the upper protrusion face. The coping cleat preferably includes an upper cleat portion extending along or adjacent to the protrusion's upper surface, an outer cleat portion extending downwardly at or adjacent the outer protrusion face from an outer side of the upper cleat portion, and an inner cleat portion extending generally downwardly along or adjacent to the inner protrusion face from an opposite, inner side of the upper cleat portion. A coping cover or cap has an upper cap portion, an outer cap portion extending generally downwardly from an outer side of the upper cap portion and an inner cap portion extending generally downwardly from an opposite, inner side of the upper cap portion. The outer and inner cap portions are secured to the respective outer and inner cleat portions, preferably by way of generally hook-shaped cap portion edges that allow for snap-on installation onto the outer and inner cleat portions.

A spring clip is secured to the coping cleat and is disposed between the coping cleat and at least a portion of the coping cap, with the spring clip having at least one resilient spring clip protrusion resiliently engaging a portion of the underside of the coping cap for maintaining a resiliently-biased tight-fitting assembly. A coping locator is also provided and is preferably secured (at least along one side edge) to the coping cleat between the coping cleat and the coping cap. The coping locator protrudes from the coping cleat to engage a portion of the underside of the coping cap in order to space such portion of the coping cap a predetermined, generally fixed distance from the coping cleat. The locator also maintains at least a portion of the coping cap in a predetermined cross-sectional shape. In one preferred embodiment of the invention, the locator has one side edge that is free-floating in order to allow the locator to resiliently yield and better facilitate the installation of the coping cap while still performing its locating and support functions for the coping cap.

Such coping cleats and coping caps according to the present invention are typically in longitudinally-extending sections of the predetermined length. In installations where more than one section is required, the coping cap sections serially and abuttingly engage one another along the raised protrusion on the building roof. In such installations, the present invention provides a joint cover disposed between the underside of adjacent coping cap sections and the coping locator at the abutting engagement of adjacent coping cap sections. The joint cover is preferably of substantially the same lateral cross-sectional configuration as the coping cap. Thus the coping locator, which is preferably of a configuration that is symmetrical with respect to a line normal to the adjacent surface of the raised roof protrusion, provides additional strength for the joint as well as working in conjunction with the joint cover to maintain the abutting ends of the adjacent coping cap sections in proper alignment with one another and to minimize entrainment of wind or water.

Although the various components of the embodiments described below are preferably fabricated of sheet metal, such as galvanized steel, for example, other sheet or even molded materials can also be used. Also, the tab-locking arrangements discussed below are generally interchangeable with driven or threaded fasteners or various welding attachments.

Additional objects, advantages, and features of the present invention will become apparent from the following description and the appended claims, taken in conjunction with the accompanying drawings.

DETAILED DESCRIPTION OF THE PREFERRED EMBODIMENTS

Figure 1:
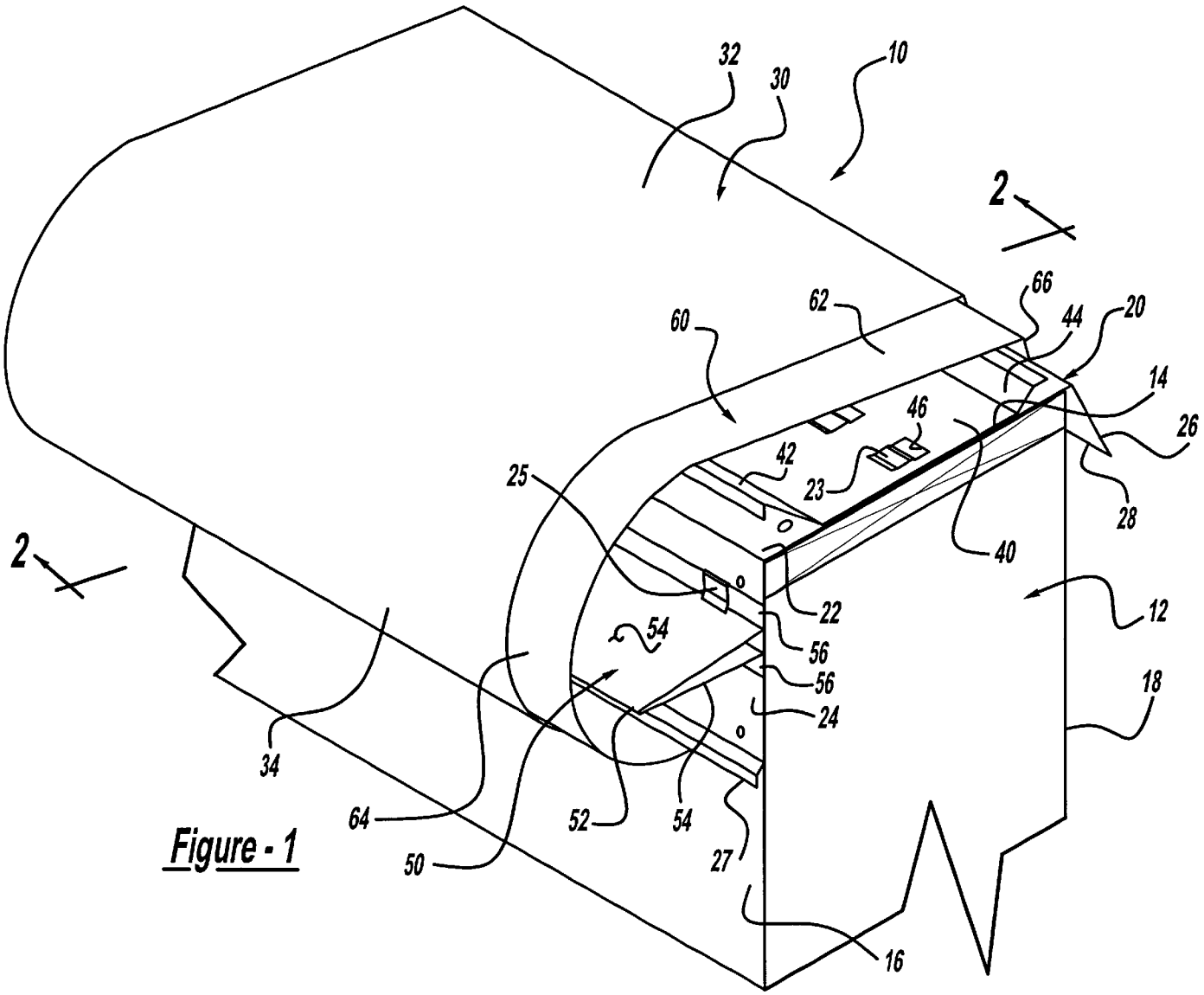
FIG. 1 is a partial, detailed perspective view of a portion of a coping assembly according to the present invention installed upon an exemplary parapet wall.
Figure 2:
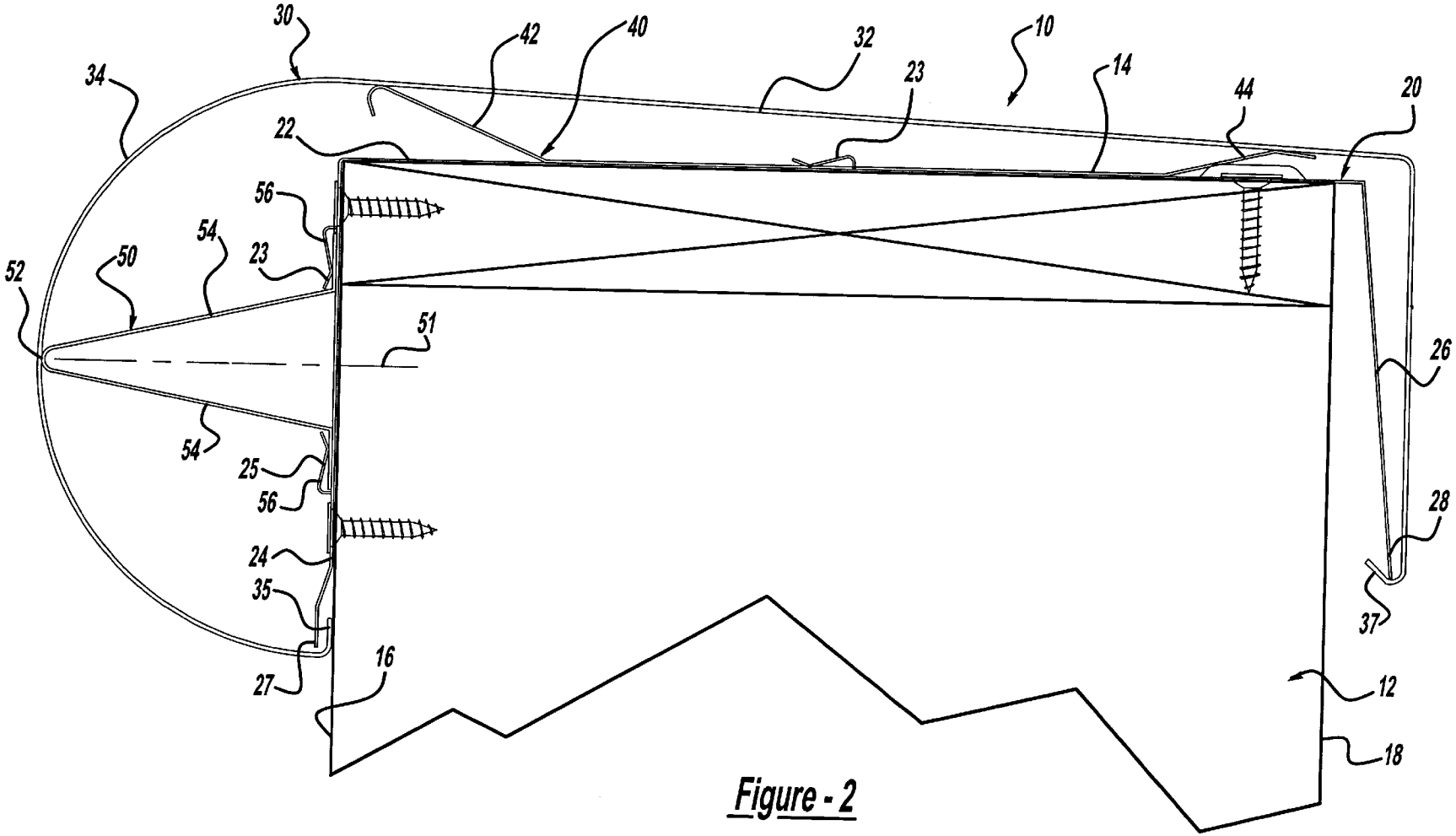
FIG. 2 is a lateral cross-sectional view, taken generally along line 2—2 of FIG. 1.
Figure 3:
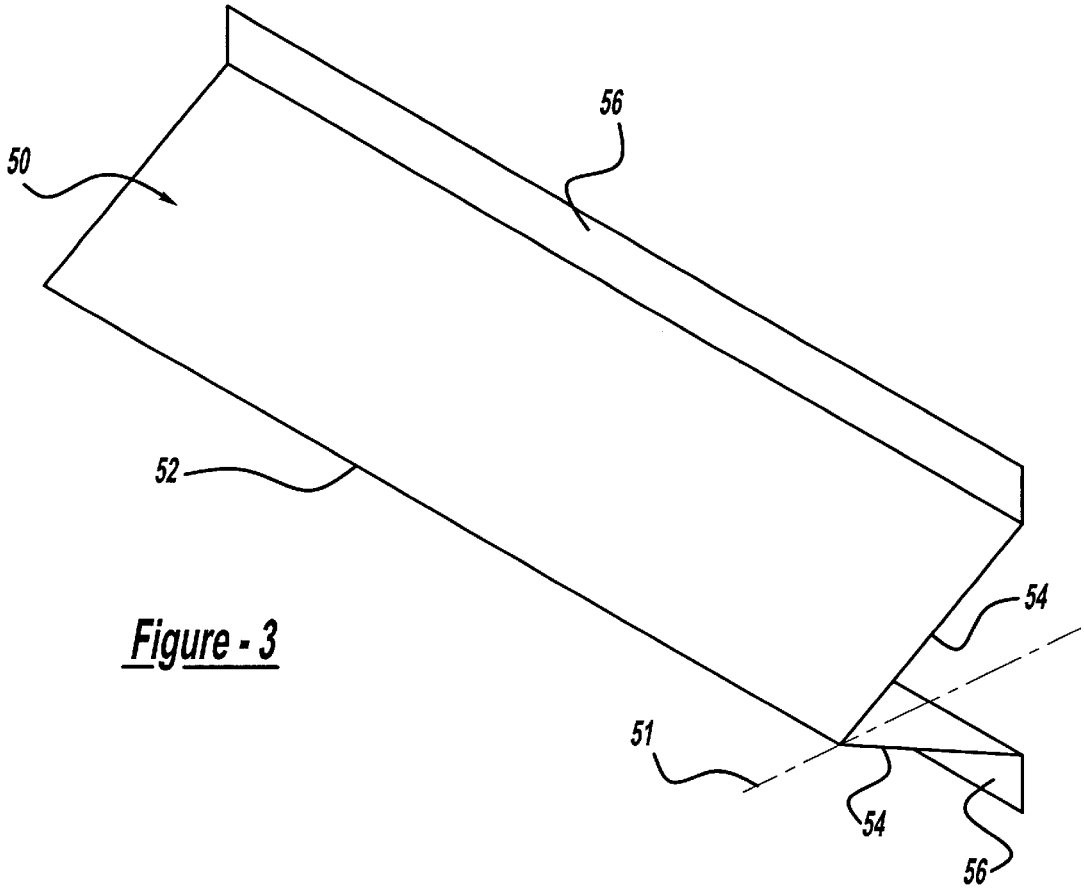
FIG. 3 is a perspective view of a portion of the coping cap locator member of FIGS. 1 and 2.
Figure 4:
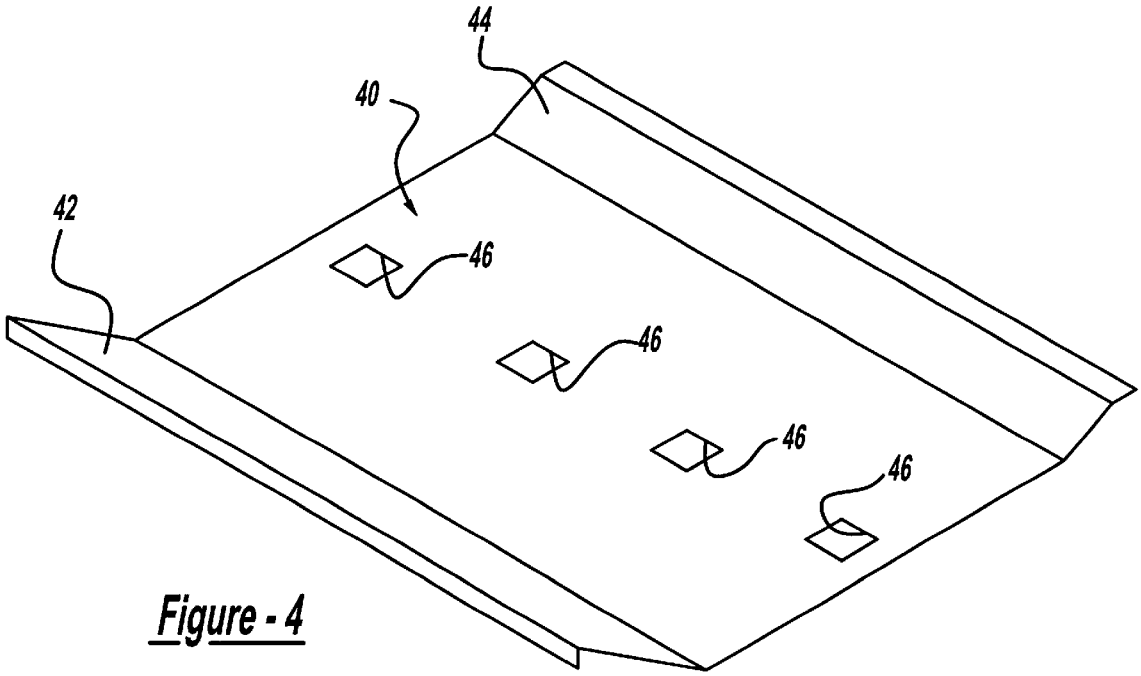
FIG. 4 is a perspective view of the spring clip member of FIGS. 1 and 2.

FIGS. 1 through 20 illustrate various embodiments of a coping assembly according to the present invention, shown merely for purposes of illustration as installed on various configurations of parapet walls, cant dams, or gravel stops. One skilled in the art will readily recognize, however, that the principles of the present invention are equally applicable to other coping assemblies having lateral cross-sections varying from those shown for purposes of illustration in the drawings, as well as for installation on other configurations of raised protrusions extending generally upwardly from any portion of the roof of a building.

FIGS. 1 through 4 illustrate one preferred embodiment of a coping assembly 10 shown merely for purposes of illustration as installed upon a parapet wall 12 such as that frequently found running along or adjacent to the edge of a building roof, as well as on other inboard roof areas. The parapet wall 12 includes a parapet upper surface 14, a parapet outer face 16, and a parapet inner face 18. It should be noted that the designations "outer" and "inner" are used herein are for convenience of reference to the drawing figures and do not necessarily refer to the side of a structure or component oriented toward the outer or inner portions, respectively, of the building roof.

A coping cleat 20 is adapted for being fixedly secured to the parapet wall 12, or other such raised protrusion, extending longitudinally along the roof of a building. The coping cleat 20 includes an upper cleat portion 22 extending generally horizontally in this embodiment across the generally horizontal illustrative parapet upper surface 14. An outer cleat portion 24 extends generally downwardly along or adjacent to the paraper outer face 16 on one side of the upper cleat portion 22, and an inner cleat portion 26 extends generally downwardly from an opposit side of the upper cleat portion 22 along or adjacent to the parapet inner face 18.

A coping cap 30 is interlockingly installed upon the coping cleat 20, preferably in a snap-on engagement therewith by way of its generally hook-shaped outer and inner cap edges 35 and 37 in snap-on engagement with respective outer and inner cleat edges 27 and 28. The coping cap 30 includes an upper cap portion 32, an outer cap portion 34 extending generally downwardly from one side of the upper cap portion 32, and an inner cap portion 36 extending generally downwardly from an opposite or inner side of the upper cap portion 32. In the particular embodiment illustrated in FIGS. 1 through 4, the outer cap portion 34 is fabricated in a generally semi-circular or "bullnose" configuration. It should be noted that other shapes can be used in the present invention and that such bullnose or other cross-sectional shapes can be used on either or both of the outer and inner sides of the assembly.

A spring clip 40 is secured to the coping cleat 20 and includes one or more of the resilient spring clip protrusions 42 and 44 resiliently engaging respective portions of the underside of the coping cap 30. The spring clip 40 is preferably secured to the coping cleat 20 by way of a number of cleat tabs 23 spaced longitudinally along the upper cleat portion 22 with each of the cleat tabs 23 extending through corresponding longitudinally spaced-apart spring clip openings 46 in order to tightly engage and secure the spring clip 40. It should be noted though that other fastening arrangements can alternatively be used to secure the spring clip 40 to the coping cleat 20. The arrangement depicted in FIGS. 1 through 4, however, is believed to be highly advantageous in terms of speed, ease, and economy of installation.

A coping locator member 50, which is preferably symmetrical with respect to a line 51 normal to the face of the parapet wall 12, is of a generally triangular lateral cross-sectional shape in the embodiment of FIGS. 1 through 4, with a locator apex 52 between two equal-length locator sides 54. In the embodiment of FIGS. 1 through 4, the coping locator 50 is preferably secured to the face of the coping cleat 20 by way of spaced-apart, oppositely-facing outer cleat tabs 25. In this configuration, which is believed to result in quick, easy, and economical installation, the locator sides 54 are merely squeezed toward one another until respective locator flanges 56 can clear the cleat tabs 25, whereupon the locator sides 54 are released such that the locator flanges are captured and secured by the cleat tabs 25, providing a tight, rattle-free securement. The preferred generally symmetrical configuration of the coping locator 50 also maintains the illustrative bullnose outer cap portion 34 in a uniform predetermined lateral cross-sectional shape and at a predetermined spacing from the face of the parapet wall 12.

As mentioned above, the coping assembly 10 is typically fabricated in longitudinal sections of a predetermined length. In order to provide the above-mentioned advantages of the invention in installations requiring more than one coping cap sections, a joint cover 60, illustrated in FIG. 1, is provided to bridge the longitudinal abutment of adjacent coping cap sections. The joint cover 60 preferably includes an upper joint cover portion 62, an outer joint cover portion 64, and an inner joint cover portion 66. In its preferred form, the joint cover 60 has substantially the same lateral cross-sectional shape as the coping cap 30, but sized slightly smaller so it can be disposed between the coping cap 30 and the coping cleat 20, as well as between the coping cap 30 and the spring clip 40. Perhaps even more importantly, though, such complementary cross-sectional shape of the joint cover 60 and the coping cap 30 allows the joint cover 60 to also be disposed between the coping cap 30 and the coping locator 50, thus substantially assuring proper alignment between adjacent coping cap sections, as well as providing structural support for the abutting joint and maintenance of the desired lateral cross-sectional shape. In all of the embodiments discussed herein, tab-type securements, driven or threaded fastener securements, and welding securements are interchangeable with one another.

As mentioned above, FIGS. 5 through 20 illustrate a number of alternative embodiments of the present invention, wherein identical, similar or corresponding components are indicated by reference numerals corresponding to those of FIGS. 1 through 4 but having respective reference numeral prefixes ranging from one-hundred to twelve-hundred in FIGS. 5 through 20. In most if not all respects, however, such correspondingly-numbered elements perform substantially the same, or at least similar, functions as those of FIGS. 1 through 4.

Figure 5:
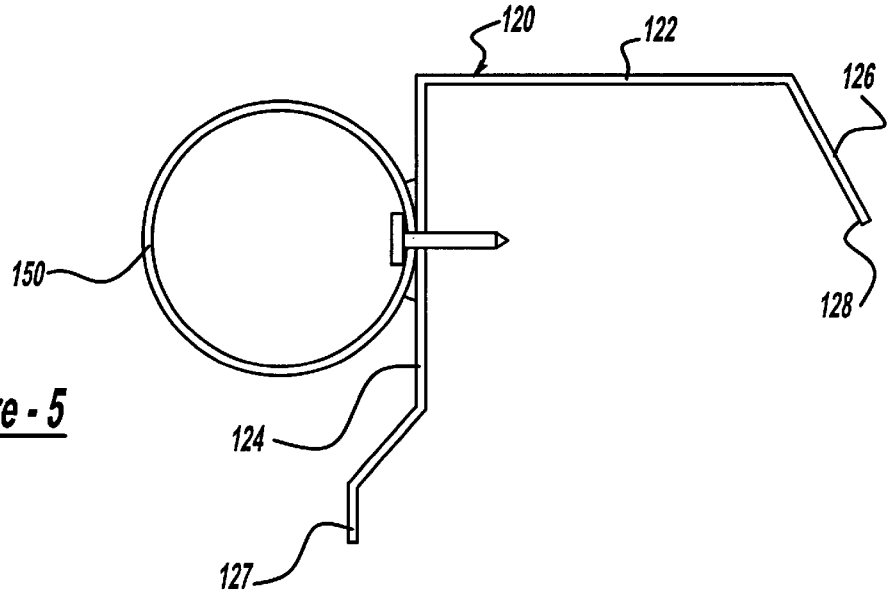
FIGS. 5 through 10 are illustrative diagrammatic lateral cross-sectional views of various alternative embodiments of a coping assembly according to the present invention, all of which can to be used in conjunction with a coping cap of the same or similar general configuration as that of FIGS. 1 and 2.

FIG. 5 diagrammatically illustrates only the coping cleat 120 and the coping locator 150, and is adapted for use in conjunction with coping caps and coping covers similar or identical to those of FIGS. 1 through 4. In FIG. 5, the generally triangular-shaped coping locator 50 is replaced by a generally cylindrical, but still symmetrical, coping locator 150 secured to the outer cleat portion 124.

Figure 6:
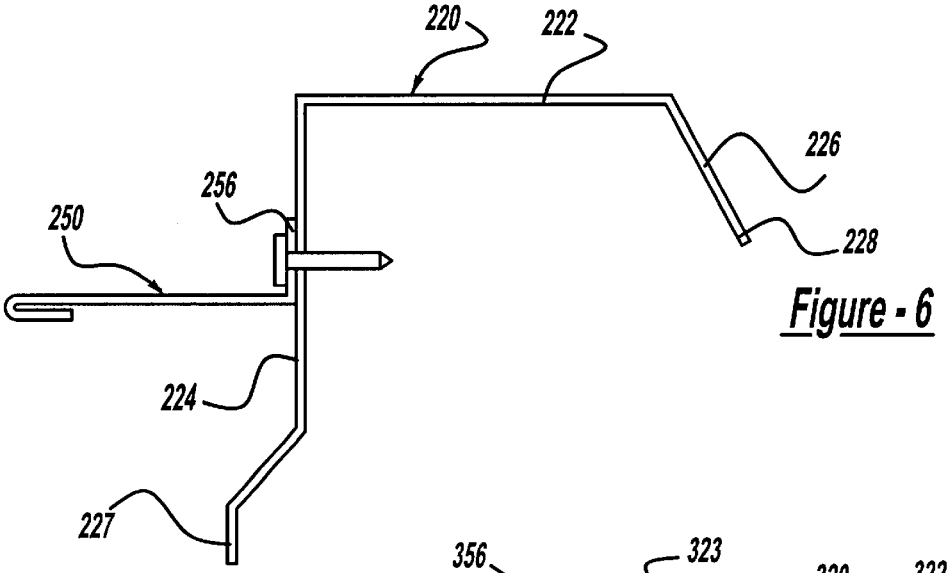

In FIG. 6, an alternative coping locator 250 is shown installed on a coping cleat 220 by way of a nail or threaded fastener extending through the locator flange 256 and through the outer cleat portion 224. It should be noted that the outer end of the coping locator 250 is folded over merely for purposes of keeping its outer end from abrading or otherwise damaging the coping cap 230. In terms of its structural support and its capabilities of maintaining the coping cap in a predetermined cross-sectional shape, the outwardly-protruding portion of the coping cap locator 250 is considered to be substantially symmetrical with respect to a line normal to the outer face of the outer cleat portion 224.

Figure 7:
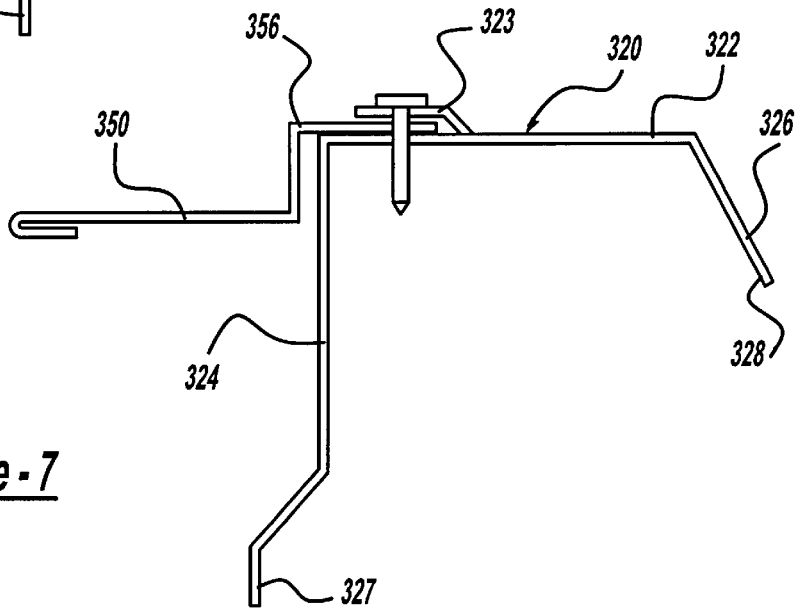

FIG. 7 illustrates yet another embodiment, similar to that of FIG. 6, except that the coping locator 350 is secured to the coping cleat 320 by way of a locator flange 356 which can be captured and secured by an upper cleat tab 323 and/or a driven or threaded fastener or even by welding methods, such as TIG, MIG, or spot welding. It should further be noted that in any of the alternate embodiments of FIGS. 5 through 10, such a cleat tab securing arrangement can be provided and/or a driven or threaded fastener can be used.

Figure 8:
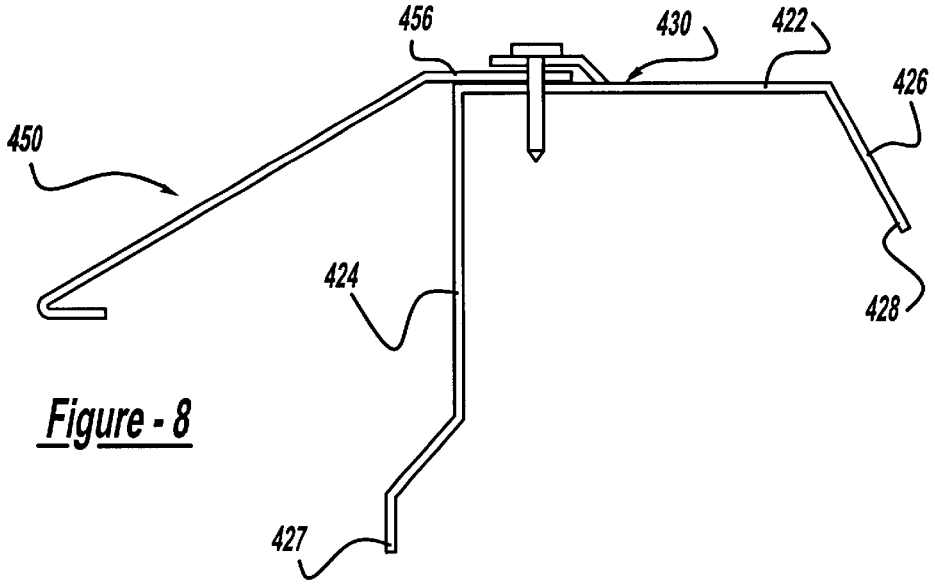

FIG. 8 illustrates an arrangement similar to that of the alternative embodiment of FIG. 7, except that the outwardly-protruding portion of the coping locator 450 extends generally outwardly and downwardly with respect to the outer cleat portion 424 of the coping cleat 420. This arrangement is especially well-suited for installations where greater coping locator lateral flexibility may be deemed to be advantageous or desired.

Figure 9:
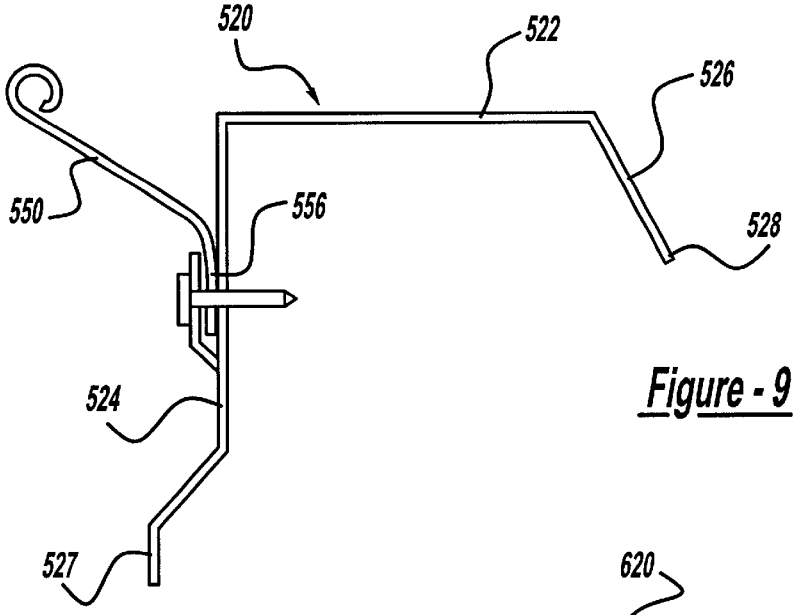

FIG. 9 illustrates a coping locator 550 similar to that of FIG. 8, but with its outwardly-protruding portion extending generally outwardly and upwardly from the outer cleat portion 524 of the coping cleat 520.

Figure 10:
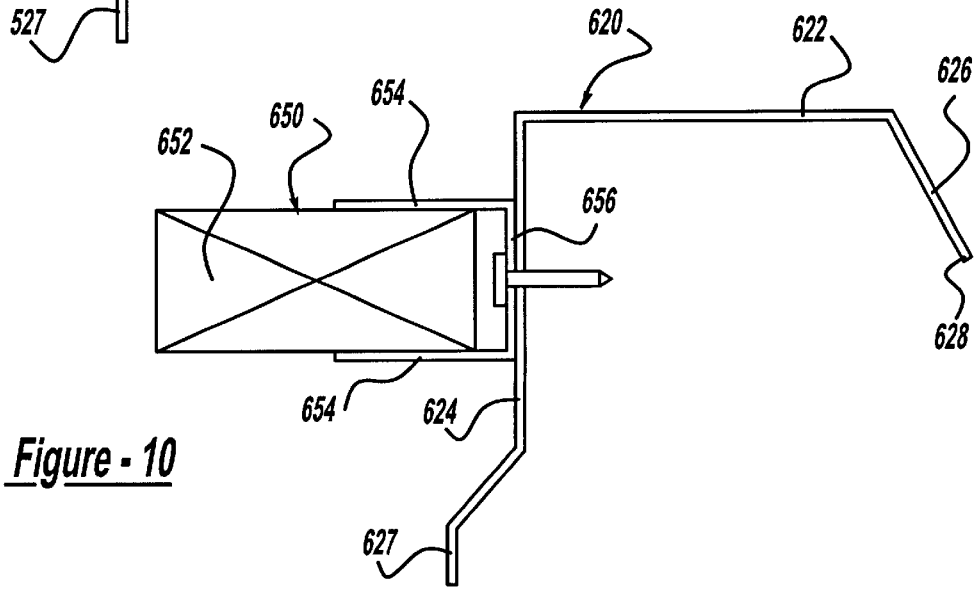

In FIG. 10, still another alternate arrangement includes a symmetrical coping locator assembly 650, having a two-piece configuration. In FIG. 10, the outwardly-protruding portion of the coping locator assembly 650 is composed of wood or other suitable building material and is grippingly secured in place by a pair of spaced-apart coping locator sides 654 that extend horizontally outwardly from a coping locator flange portion 656.

Figure 11:
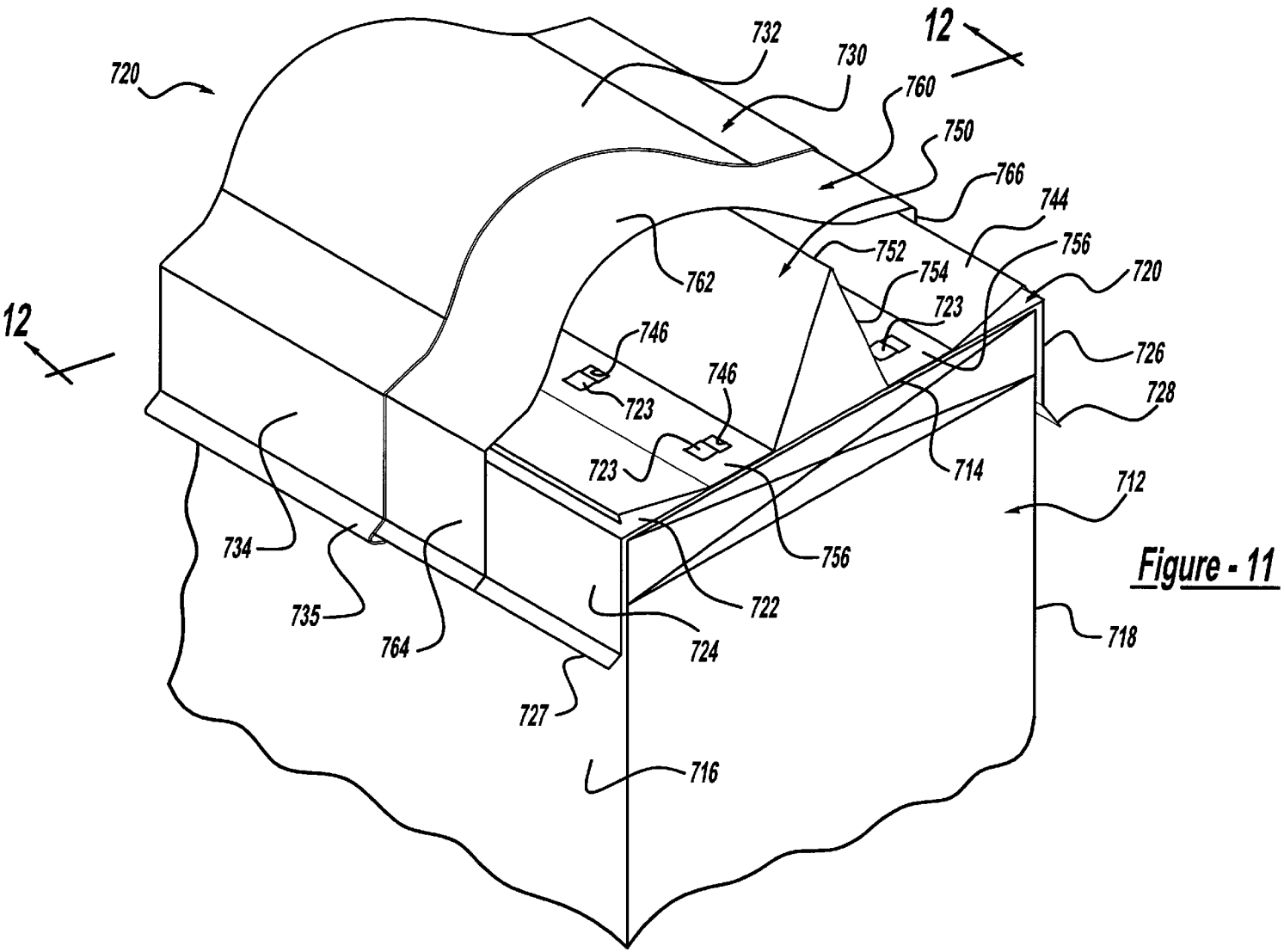
FIG. 11 illustrates yet another alternative embodiment of a coping assembly according to the present invention, shown in a partial, detailed perspective view similar to that of FIG. 1
Figure 12:
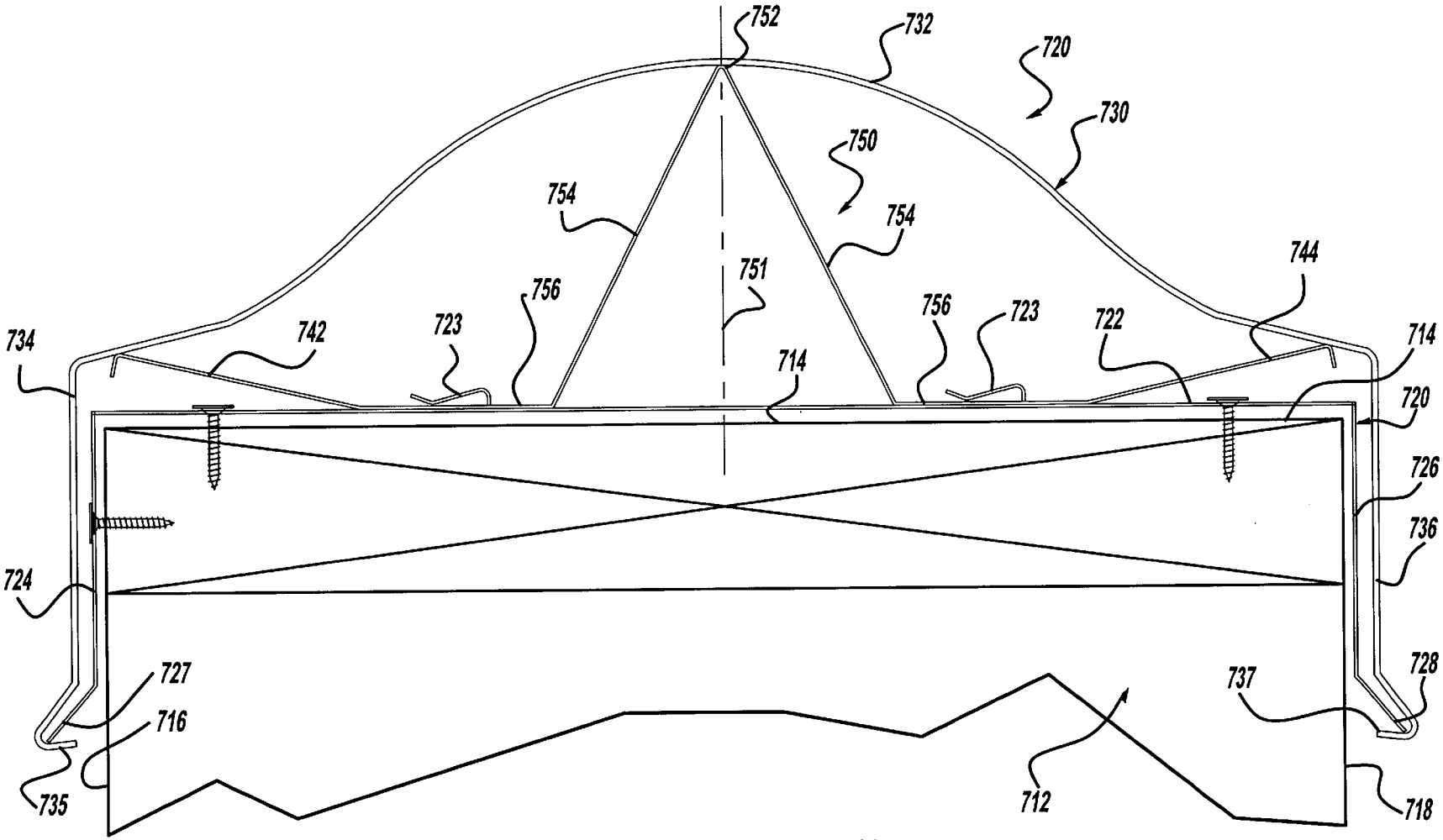
FIG. 12 is a lateral cross-sectional view, taken generally along line 12—12 of FIG 11.
Figure 13:
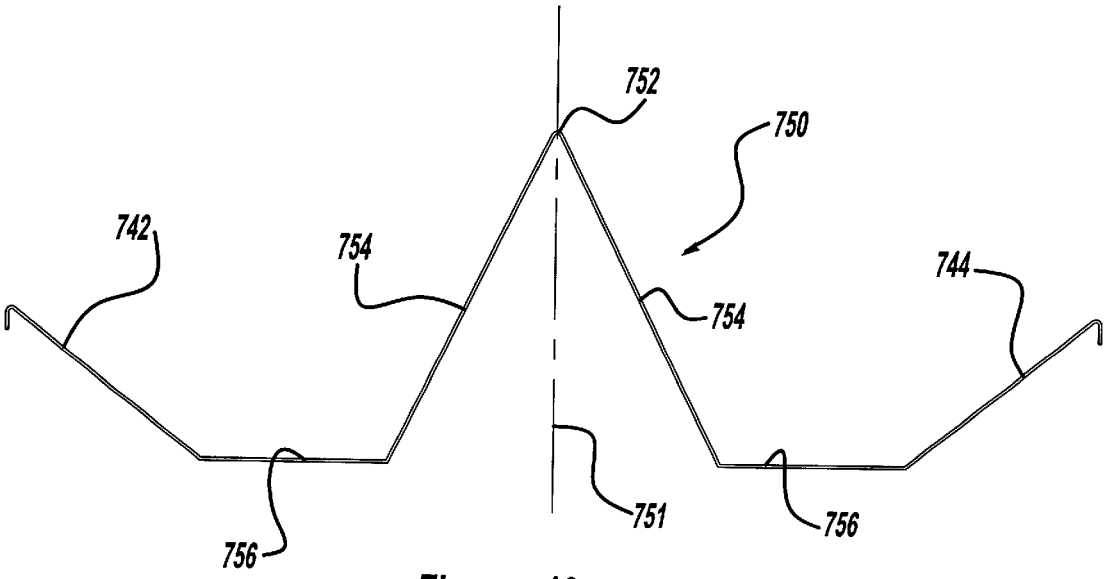
FIG. 13 is a lateral cross-sectional view of the combination spring clip and cap locator member of FIGS. 11 and 12.

FIGS. 11 through 13 illustrate a somewhat more diverse alternate embodiment of the present invention, having a coping assembly 720 that includes a coping cap 730 that straddles and overlies the outer and inner sides 724 and 726, respectively, of the coping cleat 720. The upper coping cap portion 732 is generally "peaked" or "humped" in lateral cross-sectional shape. In this embodiment, a pair of oppositely-facing sloped resilient spring protrusions 742 and 744 are incorporated into the coping locator 750 and resiliently engage the undersides of the coping cap 730 and the joint cover 760 at the abutment of longitudinally adjacent coping cap sections. The coping locator 750 is secured to the coping cleat 720 and is symmetrical with respect to a line 751 extending in a normal direction with respect to the upper parapet surface 714 of the parapet wall 712. Thus, in the embodiment illustrated in FIGS. 11 through 13, the coping locator 750 also has a locator apex 752 that engages the undersides of both the coping cap 730 and the joint cover 760 in order to maintain the above-discussed predetermined cross-sectional shape, vertical spacing from the parapet wall 712, as well as the proper alignment between longitudinally-adjacent coping cap sections.

Figure 14:
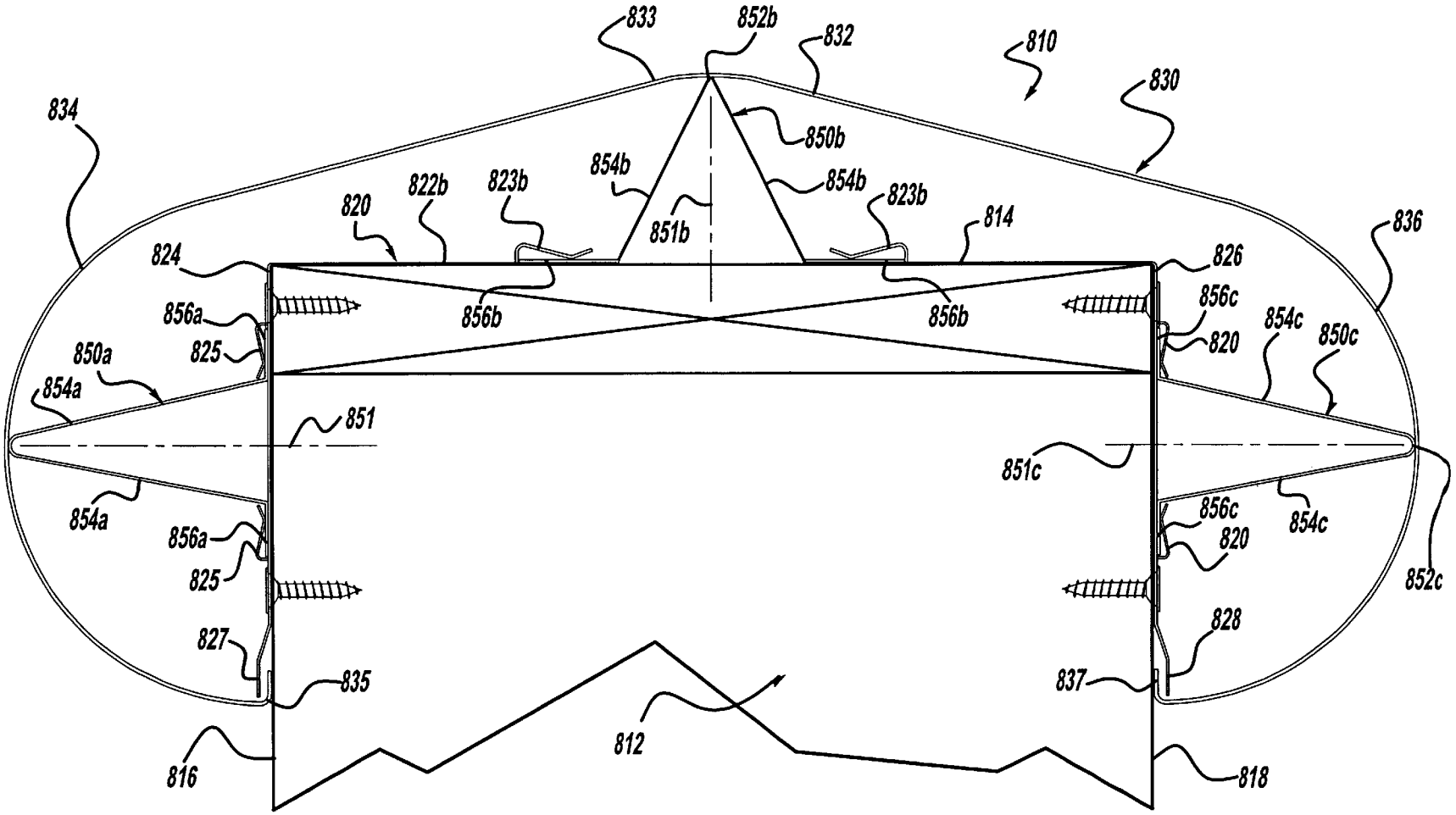
FIGS. 14 through 17 are lateral cross-sectional views, somewhat similar to that of FIG. 12, but illustrating still further alternate embodiments of the present invention.

FIG. 14 illustrates yet another alternate embodiment of the present invention, generally similar to that of FIGS. 11 through 13, except that three coping locators 850*a*, 850*b*, and 850*c*, are provided for engagement with the undersides of the coping cap 830 and its complementary and associated joint cover (not shown).

Figure 15:
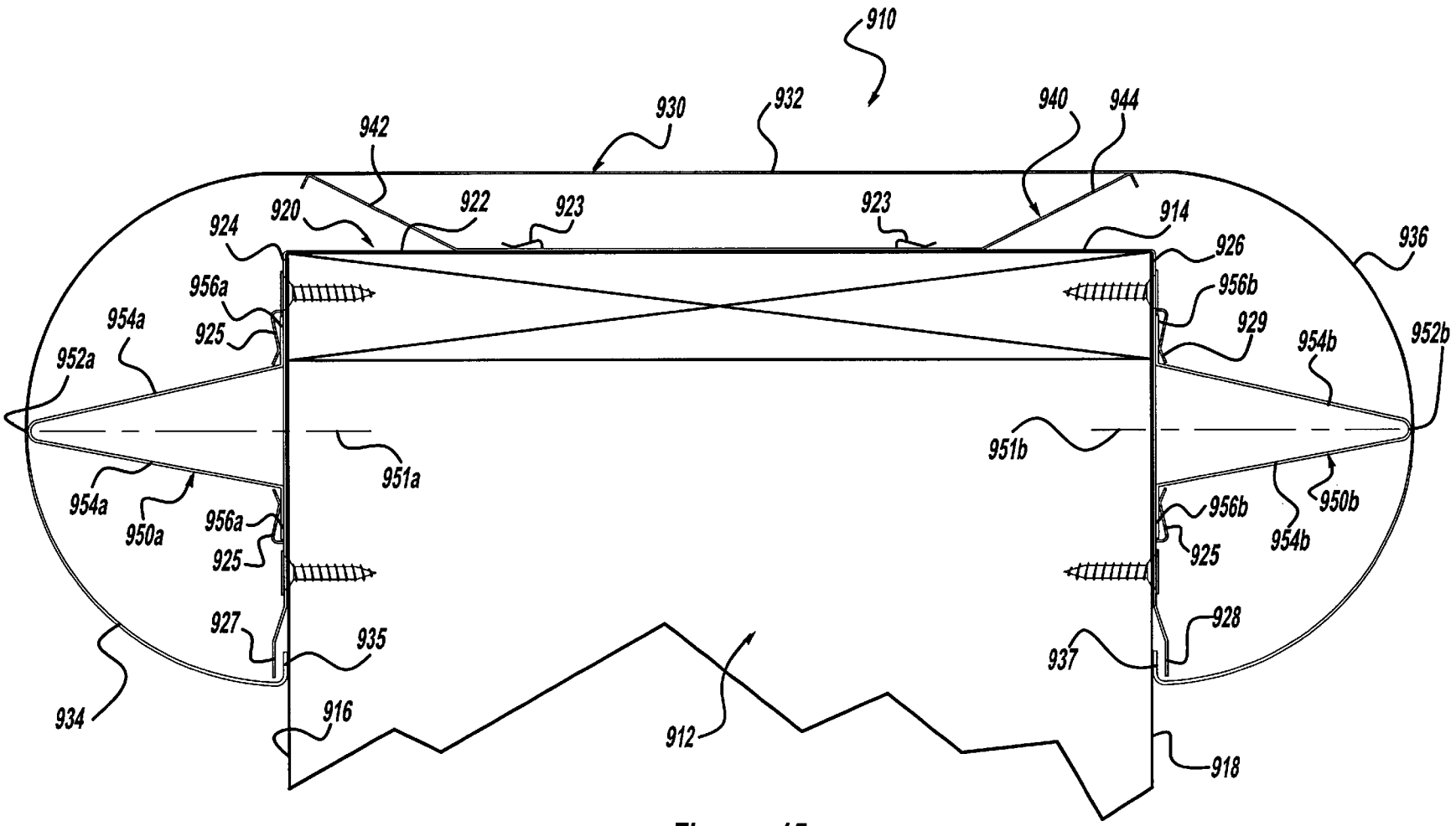

In FIG. 15, still another alternate embodiment is somewhat similar to that of FIG. 14, except that the peaked upper portion of the coping cap 830 is eliminated and replaced by a generally horizontal and generally flat upper cap portion 932. Thus, only the two coping locators 950*a* and 950*b* are typically required. It should be noted, however, that a third coping locator could alternatively be provided on the upper cleat portion 922 for engagement with the underside of the upper cap portion 932 and the complementary joint cover (not shown).

Figure 16:
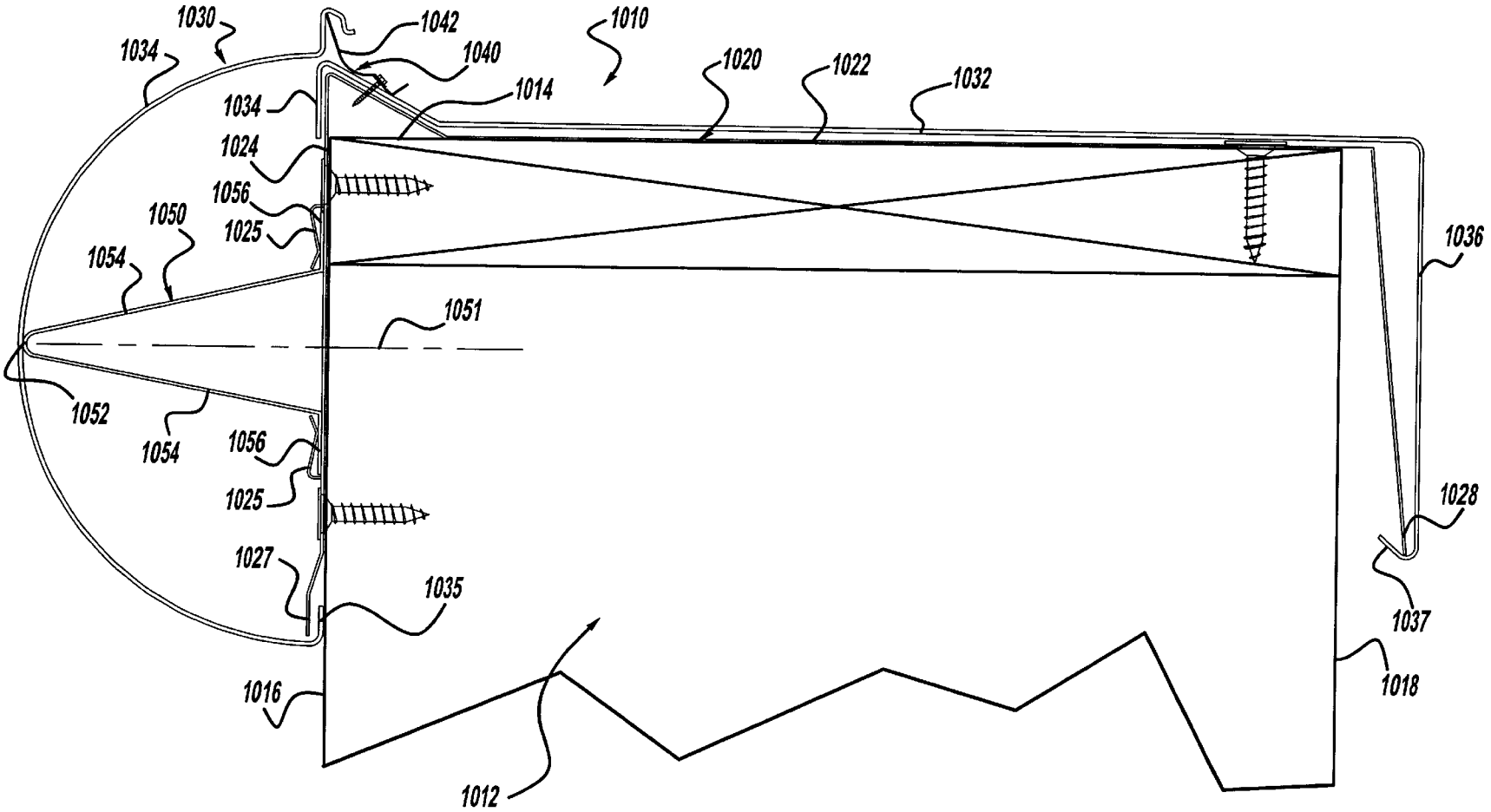

In FIG. 16, another somewhat diverse alternate embodiment of the present invention is illustrated with the coping cap 1030 being formed in a two-piece assembly separated generally between the outer cap portion 1034 and the upper cap portion 1032. In addition, the coping cleat 1020 is formed of a configuration having a gravel stop or cant dam configuration with the upper cleat portion 1022 having an upwardly and outwardly sloped portion extending toward the outer cleat portion 1024. In this embodiment, a somewhat different spring clip 1040 is secured to such upwardly and outwardly sloping portion of the coping cleat 1020 as well as to a similarly upwardly and outwardly sloping portion of the upper cap portion 1032 of the coping cap assembly 1030. Such securement of the spring clip 1040 can be accomplished by way of threaded fasteners, as illustrated in FIG. 16, or by way of gripping tabs on the coping cap 1030 and/or on the coping cleat 1020, with the tabs extending through spaced-apart openings in the spring clip 1040, similar to those discussed above in connection with previously-described embodiments.

Figure 17:
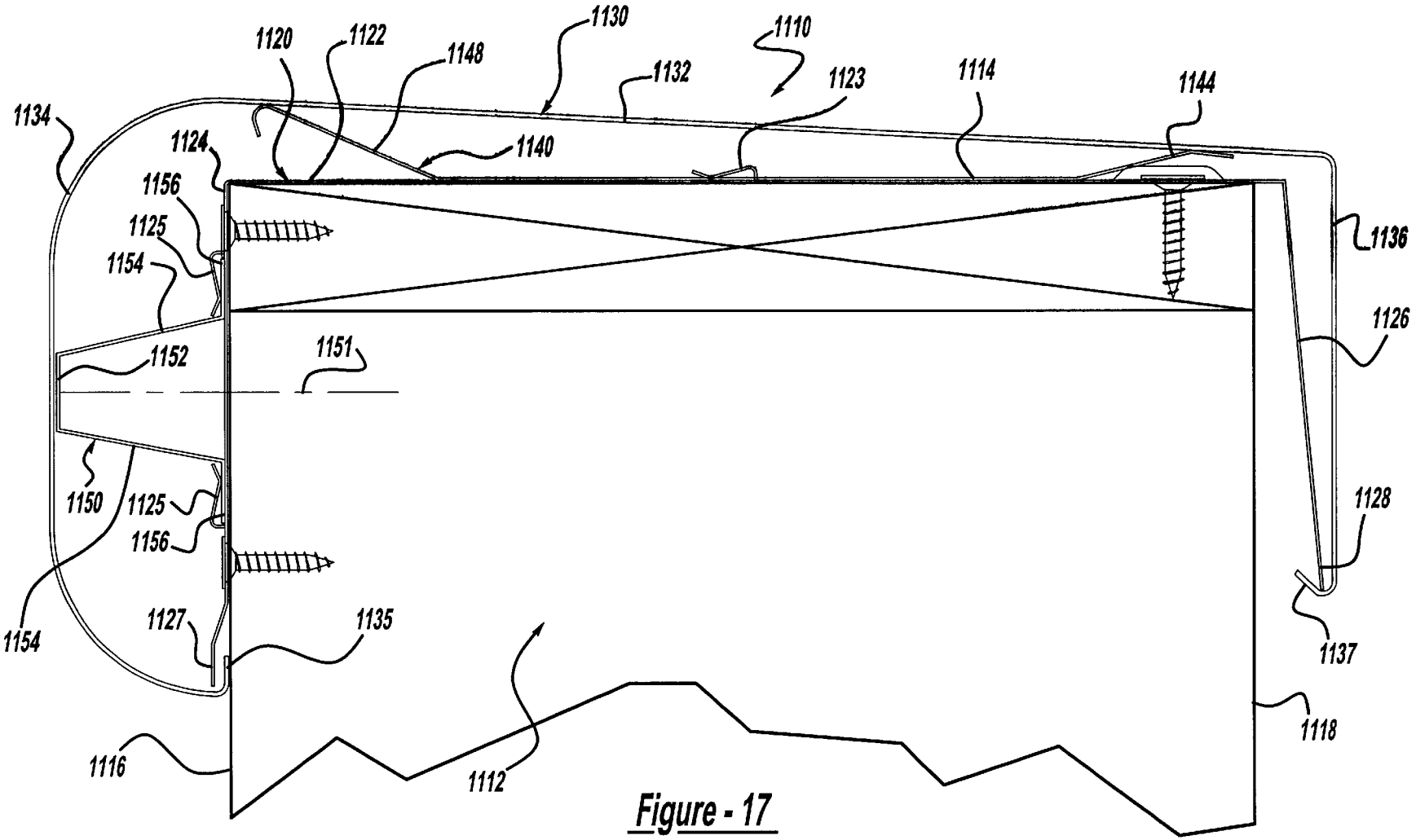

FIG. 17 illustrates still another alternate embodiment of the present invention, wherein the outer cap portion 1134 of the coping cap 1130 has a generally vertically-extending flat portion. In such an embodiment, the symmetrical coping locator has a correspondingly generally flat outer locator "apex-like" portion 1152 between the locator sides 1154. In other respects, the elements of this and the previously-discussed alternate embodiments are generally similar in configuration and/or function to the elements depicted in the first-discussed embodiment of FIGS. 1 through 4.

Figure 18:
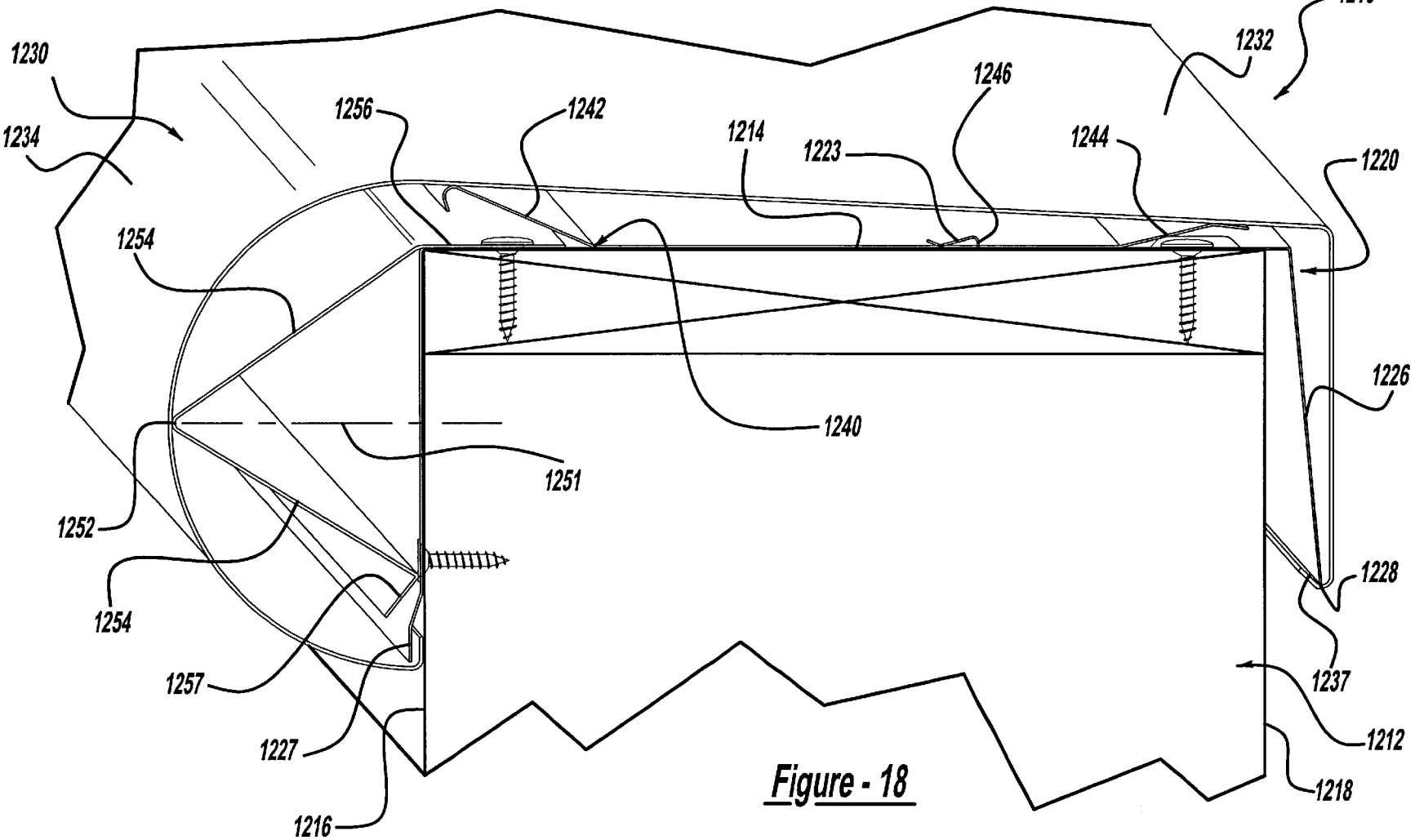
FIG. 18 is a partial perspective view of another preferred embodiment of a coping assembly according to the present invention.
Figure 19:
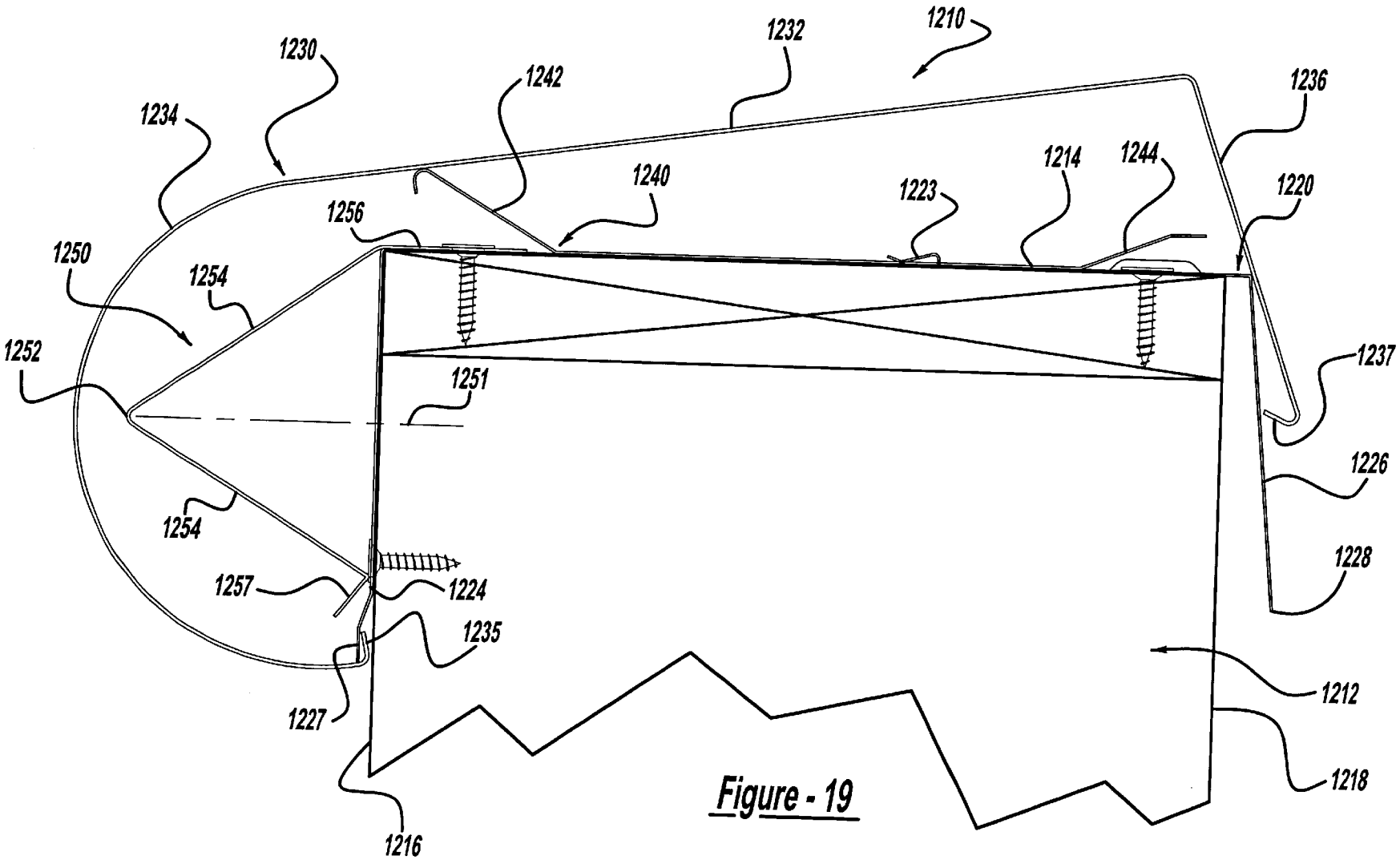
FIG. 19 is a cross-sectional view of the coping assembly of FIG. 18, but illustrating the installation of the coping member.
Figure 20:
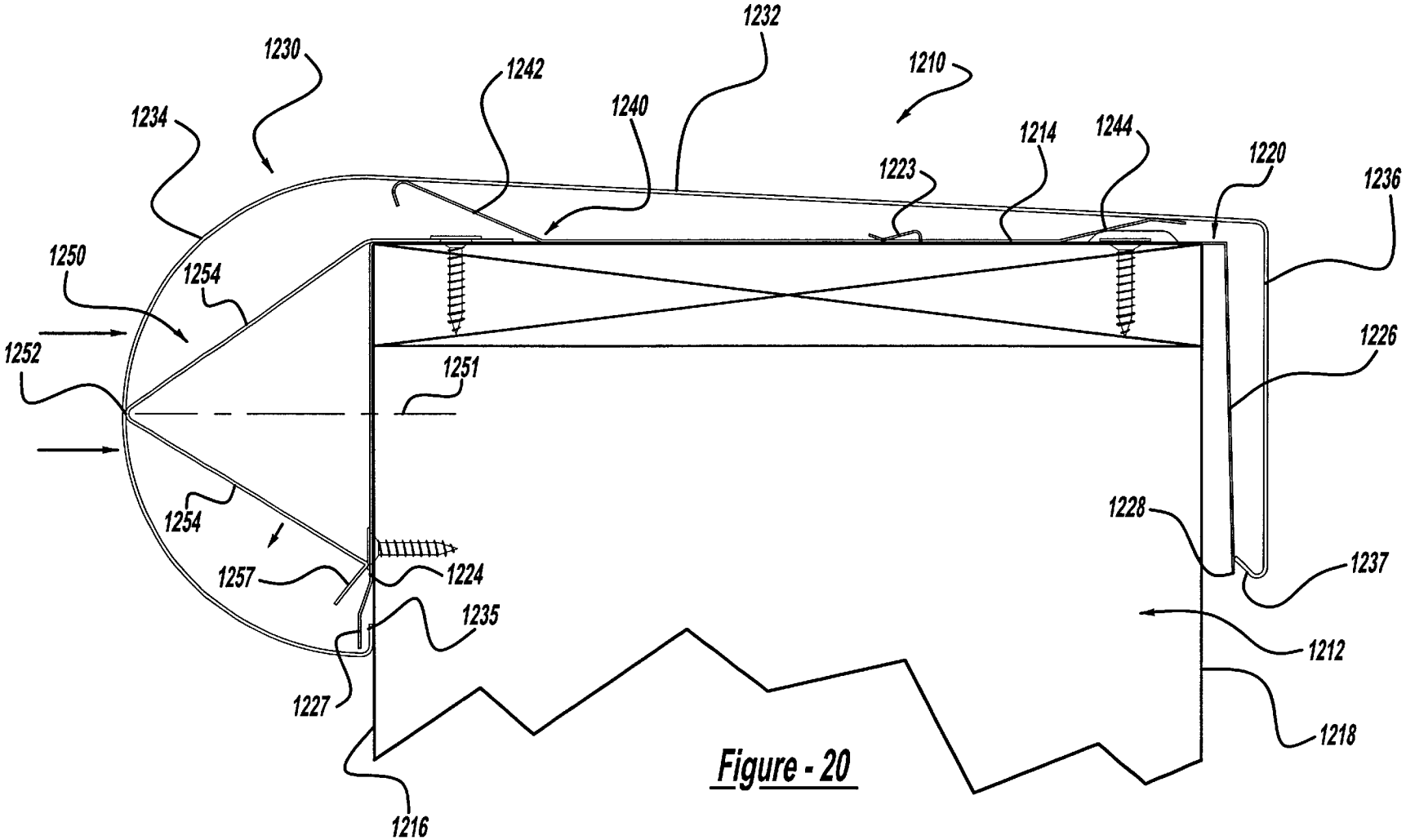
FIG. 20 is a cross-sectional view similar to that of FIG. 19, but illustrating the coping member just prior to its complete installation.

FIGS. 18 through 20 illustrate another preferred embodiment of the present invention, which is somewhat similar to the embodiment of FIGS. 1 through 4, but with the exceptions discussed below. It should be noted, however, that the embodiment depicted in FIGS. 18 through 19 is merely exemplary in that it shows a coping locator protruding outwardly and generally horizontally from the outer face of the cleat. The concepts shown in FIGS. 18 through 20, however, are equally applicable as a modification to any of the embodiments of the invention, including those having a coping locator (or locators) extending upwardly from the upper face of the cleat and/or outwardly or inwardly from the outer face or inner face of the cleat, respectively.

In FIGS. 18 through 20, the coping locators of FIGS. 1 through 17, for example, are replaced by a coping locator 1250, having upper and lower locator sides 1254. The coping locator 1250 preferably has a locator flange 1256 at the upper side edge of the upper locator side 1254 and a free-floating locator flange 1257 adjacent the lower side edge of the lower locator side 1254. In the exemplary embodiment of FIGS. 18 through 20, the lower locator side 1254 and the free-floating locator flange 1257 intersect transversely to form a free-floating locator side edge that is free to move or float relative to the coping cleat 1220.

Because of this arrangement, the coping locator 1250 is yieldable, or resiliently compressible, in order to better facilitate the ease of installation of the coping cap 1230. Such installation is illustrated in FIGS. 19 and 20, which show the coping cap near the beginning of its installation and just prior to its complete installation, respectively, onto the coping cleat 1220. This has been found to provide such ease of coping cap installation while still maintaining the necessary support and shape-maintenance functions of the coping locator for the coping cap.

In the preferred illustrative example shown in FIGS. 18 through 19, the preferred free-floating side edge, formed by the transverse intersection of the lower locator side 1254 and the free-floating locator flange 1257, is preferably in a slidable, free-floating contact or engagement with the coping cleat 1220. The coping locator 1250 is symmetrical about a line normal to the surface of the coping cleat 1220 and the wall 1212 from which it protrudes. Furthermore, the preferred coping locator 1250 shown in FIGS. 18 through 20 has a generally triangular lateral cross-sectional shape such that the normal line 1251 extends through the apex 1252 between two equal sides 1254 of the generally triangular cross-sectional shape of the coping locator 1250 at least before and after the installation of the coping cap 1230. In other respects, however, the coping assembly 1210 of FIGS. 18 through 20 is generally similar in function and/or configuration to the embodiments of FIGS. 1 through 17, which have fixed coping locator side edges rather than the free-floating side edge of the coping locator 1250. It should also be noted that the free-floating side edge of the coping locator 1250 can alternatively be in contact with, out of contact with, the coping cleat 1220 until installation of the coping cap 1230.

As mentioned above, in all embodiments the tab-type securements and the driven or threaded fastener securements described herein are generally interchangeable with each other, or with various welding securements (e.g., TIG, MIG, or spot welding), as well as with other fastening means known to those skilled in the art.

The foregoing discussion discloses and describes merely exemplary embodiments of the present invention for purposes of illustration only. The various illustrative alternate embodiments depicted and described herein demonstrate the flexibility of the applicability of the present invention to widely diverse installations. One skilled in the art will readily recognize from such discussion, and from the accompanying drawings and claims, that various changes, modifications, and variations can be made therein without departing from the spirit and scope of the invention as defined in the following claims.

What is claimed is:

1. A coping for a raised protrusion protruding generally upwardly from a surface, the raised protrusion extending in a longitudinal direction and having a protrusion upper surface, a protrusion outer face extending generally downwardly from one side of the protrusion upper surface, and a protrusion inner face extending generally downwardly from an opposite side of the protrusion upper surface, said coping comprising:

a coping cleat for fixed securement to the raised protrusion, said cleat having an upper cleat portion extending along the protrusion upper surface, an outer cleat portion extending generally downwardly along the protrusion outer face from an outer side of said upper cleat portion, and an inner cleat portion extending generally downwardly along the protrusion inner face from an opposite inner side of said upper cleat portion;

a coping cap having an upper cap portion, an outer cap portion extending generally downwardly from an outer side of said upper cap portion, and an inner cap portion extending generally downwardly from an opposite inner side of said upper cap portion, said outer and inner cap portions having edges secured to said respective outer and inner cleat portions;

a spring clip secured to said coping cleat and disposed between said coping cleat and said coping cap, said spring clip having at least one resilient spring clip protrusion resiliently engaging a first portion of an underside of said coping cap; and a coping locator secured to said coping cleat along at least a first side edge of said locator and being disposed between said coping cleat and said coping cap, said locator protruding from said coping cleat and engaging a second portion of said underside of said coping cap in order to space said second portion of said underside of said coping cap a predetermined generally fixed distance from said coping cleat, said locator also maintaining at least a portion of said coping cap in a predetermined cross-sectional shape, said locator further having a second side edge that is free-floating relative to said cleat, said locator being yieldable during installation of said coping cap onto said locator, said spring clip and said coping cleat.

2. A coping according to claim 1, wherein said coping cap is formed in cap sections of a predetermined longitudinal length, said cap sections serially abuttingly engaging one another and extending along the raised protrusion, said coping further including a joint cover disposed between said underside of adjacent coping cap sections and said coping locator at said abutting engagement of said adjacent coping cap sections in order to maintain alignment of said adjacent coping cap sections at said abutting engagement.

3. A coping according to claim 2, wherein said joint cover and said coping cap have substantially the same cross-sectional shape.

4. A coping according to claim 2, wherein said coping cover also extends between said underside of said coping cap and said resilient spring clip protrusion.

5. A coping according to claim 4, wherein said joint cover and said coping cap have substantially the same cross-sectional shape.

6. A coping according to claim 1, wherein said coping locator protrudes from said outer cleat portion to engage said underside of said outer coping cap portion.

7. A coping according to claim 1, wherein said coping locator protrudes from said upper cleat portion to engage said underside of said upper coping cap portion.

8. A coping according to claim 1, wherein said coping locator has a first flange extending longitudinally along said first side edge, said first flange being secured to said coping cleat.

9. A coping according to claim 8, wherein said coping locator has a second flange extending longitudinally along said second side edge.

10. A coping according to claim 1, wherein said coping locator is symmetrical about a horizontal line normal to the raised protrusion outer face.

11. A coping according to claim 10, wherein said coping locator has a generally triangular lateral cross-sectional shape, said normal horizontal line extending through an apex between two equal sides of said triangular cross-sectional shape.

12. A coping according to claim 1, wherein said coping cap outer and inner cap portion have generally hook-shape edge portions thereon for snap-on engagement with respective outer and inner cleat portion edges.

13. A coping according to claim 1, wherein the raised protrusion is a free-standing wall.

14. A coping according to claim 1, wherein the raised protrusion protrudes upwardly from a building roof.

15. A coping according to claim 1, wherein the raised protrusion is a parapet wall on a building roof.

16. A coping according to claim 1, wherein said coping locator has a first flange extending longitudinally along said first side edge, said first flange being secured to said coping cleat, said second side edge being in a slidable free-floating engagement with said cleat, said coping locator being compressible to allow said slidable free-floating engagement during said installation of said coping cap.

17. A coping according to claim 16, wherein said coping locator has a second flange extending longitudinally along said second side edge, said second flange and an adjacent side portion of said coping locator transversely intersecting with one another to form said slidable free-floating second side edge.

18. A coping according to claim 1, wherein said second side edge of said coping locator is in slidable free-floating engagement with said outer cleat portion, said coping locator being resiliently yieldable during said installation of said coping cap.

19. A coping according to claim 18, wherein said coping locator is symmetrical about a line normal to the raised protrusion outer face and has a generally triangular lateral cross-sectional shape, said normal line extending through an apex between two equal sides of said triangular cross-sectional shape both before and after said installation of said coping cap.

20. A coping according to claim 1, wherein said coping locator is symmetrical about a line normal to at least one surface of the raised protrusion and has a generally triangular lateral cross-sectional shape, said normal line extending through an apex between two equal sides of said triangular cross-sectional shape at least after said installation of said coping cap.

* * * * *

UNITED STATES PATENT AND TRADEMARK OFFICE

CERTIFICATE OF CORRECTION

PATENT NO. : 6,360,504 B1 
DATED : March 26, 2002
INVENTOR(S) : William C. Webb, Neil Tedder, Christopher K. McCoy and David McKinney It is certified that error appears in the above-identified patent and that said Letters Patent is hereby corrected as shown below:

Column 8,
Line 62, the second use of the word "coping" should be replaced with -- joint --.

Signed and Sealed this

Tenth Day of September, 2002

*Attest:*

*Attesting Officer*

JAMES E. ROGAN
*Director of the United States Patent and Trademark Office*